US012228362B2

(12) United States Patent
Smith

(10) Patent No.: US 12,228,362 B2
(45) Date of Patent: Feb. 18, 2025

(54) CONVERSION KIT

(71) Applicant: UTM Limited, Mildenhall (GB)

(72) Inventor: Alan Smith, Mildenhall (GB)

(73) Assignee: UTM Limited, Mildenhall (GB)

( * ) Notice: Subject to any disclaimer, the term of this patent is extended or adjusted under 35 U.S.C. 154(b) by 997 days.

(21) Appl. No.: 17/256,610

(22) PCT Filed: Jul. 1, 2019

(86) PCT No.: PCT/GB2019/051867
§ 371 (c)(1),
(2) Date: Dec. 28, 2020

(87) PCT Pub. No.: WO2020/002953
PCT Pub. Date: Jan. 2, 2020

(65) Prior Publication Data

US 2021/0262753 A1 Aug. 26, 2021

(30) Foreign Application Priority Data

Jun. 29, 2018 (GB) ..... 1810773

(51) Int. Cl.
*F41A 33/00* (2006.01)
*F41A 11/02* (2006.01)
*F41A 17/64* (2006.01)

(52) U.S. Cl.
CPC ..... *F41A 33/00* (2013.01); *F41A 11/02* (2013.01); *F41A 17/64* (2013.01)

(58) Field of Classification Search
CPC ..... F41A 11/02; F41A 33/00; F41A 17/36; F41A 17/64; F41A 17/66; F41A 17/74
USPC ..... 124/28; 42/77; 89/29; 102/444
See application file for complete search history.

(56) References Cited

U.S. PATENT DOCUMENTS 3,418,741 A * 12/1968 Tschoepe ..... F41A 33/00 42/77
4,920,678 A * 5/1990 Brown ..... F41A 11/02 89/196
4,955,157 A * 9/1990 Brighton ..... F41A 11/02 102/446

(Continued)

FOREIGN PATENT DOCUMENTS

DE 273841 C 5/1914
WO 2020/002953 A1 1/2020

OTHER PUBLICATIONS

International Preliminary Report on Patentability, PCT/GB2019/051867, dated Dec. 29, 2020, 8 pages.

(Continued)

*Primary Examiner* — Alexander R Niconovich
(74) *Attorney, Agent, or Firm* — Nelson Mullins Riley & Scarborough LLP; Anthony A. Laurentano

(57) ABSTRACT

A conversion kit for converting a firearm to fire only non-lethal training ammunition comprises a barrel assembly and a slide assembly wherein the barrel assembly includes a barrel having a projection and the slide assembly includes a gate which interacts with the projection. The gate includes a member which is movable between a first 'safe' position wherein a firing pin of the firearm is blocked from impacting on a cartridge to a second 'fire' position wherein the firing pin is not blocked from impacting upon a cartridge in the chamber.

10 Claims, 3 Drawing Sheets

(56) References Cited

U.S. PATENT DOCUMENTS 5,046,275 A * 9/1991 Brown ..... F41A 11/02 42/25
5,325,617 A * 7/1994 Vojta ..... F41A 21/484 89/196
5,585,589 A * 12/1996 Leiter ..... F41A 11/02 42/75.1
5,983,773 A * 11/1999 Dionne ..... F41A 11/02 89/196
6,276,252 B1 * 8/2001 Dionne ..... F41A 3/86 89/14.05
6,314,859 B1 * 11/2001 Weichert ..... F41A 11/02 42/1.06
6,357,331 B1 * 3/2002 Dionne ..... F41A 33/00 89/194
6,571,501 B1 * 6/2003 Jennings ..... F41A 11/02 89/199
6,625,916 B1 * 9/2003 Dionne ..... F41A 11/02 102/444
6,848,208 B1 * 2/2005 Kirschner ..... F42B 33/00 42/77
7,735,409 B1 * 6/2010 Tertin ..... F41A 21/10 42/69.02
8,739,445 B2 * 6/2014 Burke ..... F41A 11/02 42/16
9,194,635 B1 * 11/2015 Gibbens ..... F41A 3/12
10,254,071 B2 * 4/2019 Dionne ..... F41A 21/00
11,215,413 B2 * 1/2022 Satzinger ..... F41C 7/00
11,274,896 B2 * 3/2022 Mehta ..... F41A 21/10
2012/0317856 A1 12/2012 Burke et al.

OTHER PUBLICATIONS

International Search Report and Written Opinion, PCT/GB2019/051867, dated Oct. 1, 2019, 13 pages.

* cited by examiner

CONVERSION KIT

RELATED APPLICATIONS

This application is a 35 U.S.C. 371 national stage filing of International Application PCT/GB2019/051867, filed Jul. 1, 2019, which claims priority to GB application 1810773.0 filed Jun. 29, 2018. The entire contents of each of which are hereby incorporated by reference.

TECHNICAL FIELD

The present invention relates to a conversion kit for converting a firearm to fire non-lethal training ammunition safely. In particular, the kit is for converting a pistol.

BACKGROUND ART

Conversion kits for use with training ammunition are known. The known conversion kits include a slide assembly and a barrel assembly. The conversion kit slide assembly replaces a slide assembly of the firearm and the conversion kit barrel assembly replaces the barrel assembly of the firearm.

The barrel assembly of a conversion kit is designed so that it will interact with the firearm and the conversion kit slide assembly. The barrel assembly generally includes a barrel and a barrel liner.

One known conversion kit includes safety features which are commonly referred to as 'headspace safety' features. In this regard, the barrel of a firearm is chambered to receive only non-lethal training ammunition. It comprises a cylindrical chamber which is internally necked down in diameter so that when a 'Live' 9×19 parabellum cartridge is installed into the chamber, the rear of the cartridge projects past the rear of the barrel. This projection of the cartridge past the rear of the barrel in turn holds the slide of the firearm in a rearward position causing the slide to be positioned 'out of battery', meaning that the firing pin will not be released (in a striker fire weapon) or impacted upon (in a hammer fire weapon), so propellant in the cartridge cannot be detonated.

In contrast, a non-lethal training cartridge that has been dimensioned to fit the chamber will not hold the slide in a rearward position and will allow the slide to be positioned 'in battery' so movement of the firing pin can cause propellant of the training cartridge in the chamber to be detonated, thereby firing the cartridge.

When training with training kit comprising training firearms and ammunition, if a 'live' round accidentally enters the chamber of the firearm then it will not be possible for the propellant in the cartridge to be detonated and so lives are not endangered and injuries are not caused to those using the training kit.

However, the known conversion kits have a number of disadvantages. In this regard, the barrel of known kits is designed such that a live round will project from the rear of the barrel, but there are limitations on how far the design can influence the 'live' round rearward in the training barrel before the conversion kit would become unusable due to operational malfunctions.

In addition, in some instances, a live round can be forced into the chamber of a training barrel and the slide can still be positioned 'in battery', so the firing pin can release and cause propellant in the cartridge to be detonated.

Unfortunately, different firearms vary in their dimensions so there is no generic dimension common to all firearms to determine how far a 'live' round must project from the rear of the barrel, so not all firearms can be converted safely with the known conversion kits to fire only training ammunition.

Therefore, the known features which provide 'headspace safety' are limited in their application and they are not suitable for converting all firearm types and models for safe training.

In light of the problems discussed above, various proposals have been made, but there remains a need for an improved conversion kit which addresses one or more of the problems presented by prior art arrangements.

The present invention aims to provide a novel conversion kit which allows safe and predictable performance when firing nonlethal ammunition.

Remarkably, the invention provides a new conversion kit wherein a firearm can be converted so that it is capable of firing non-lethal training ammunition, but not live ammunition.

In this regard, advantageously, the present invention allows firearms that were previously unsuitable for converting to training purposes, to be converted for training purposes thereby allowing more people/agencies/militaries to train safely with training ammunition.

In addition, advantageously, the present invention can be tailored to different firearms and is not restricted to specific weapons.

SUMMARY OF INVENTION

In accordance with a first aspect of the present invention there is provided a conversion kit for converting a firearm to fire only non-lethal training ammunition which comprises a barrel assembly and a slide assembly wherein the barrel assembly includes a barrel having a projection and the slide assembly includes a gate which interacts with the projection.

Preferably, the barrel has a chamber which is chambered for receiving training ammunition and it interfaces with the slide assembly which replaces the host weapon slide assembly.

Preferably, in use, the projection extends from the rear of the barrel.

In one embodiment, in use, the projection extends from the left side of the barrel. However, it will be appreciated that the projection could be positioned differently.

Preferably, the gate comprises a member which is preferably substantially cylindrical. Preferably, it has a first end and a second end, wherein the first end interacts with the projection and the second end interacts with a biasing means.

Preferably, the member is movable between a first 'safe' position wherein a firing pin of the firearm is blocked from impacting on a cartridge in the chamber. In addition, preferably, the member is movable to a second 'fire' position wherein the firing pin is not blocked from impacting upon a cartridge in the chamber.

In one embodiment, in use, the member is movable in a plane substantially horizontal and substantially perpendicular to the longitudinal axis of the chamber Preferably, the biasing means comprises a spring. In this regard, preferably, the member is spring loaded so that it is biased to the first position by the spring.

Preferably, the spring has a longitudinal axis, which is substantially parallel to a longitudinal axis of the member. In addition, preferably, the longitudinal axes of the spring and the member are substantially perpendicular to the longitudinal axis of the projection.

Preferably, interaction between the slide assembly and the barrel has been designed so that the projection acts upon the member of the gate thereby moving it from the first position to the second position. This interaction can be tailored to suit different weapon types.

The invention provides the advantage that firearms converted with the conversion kits of the invention require the gate to be moved to the second 'fire' position in order for the firing pin to impact on a cartridge in the chamber. This means that the firearm will not fire a cartridge unless a projection on the rear of barrel acts on the gate to open it. Therefore, the invention provides a safer conversion kit for a firearm to convert it to fire non-lethal training ammunition, but not live ammunition.

In a second aspect, the invention provides a firearm comprising a conversion kit of the invention.

Preferably, the firearm is a pistol,

BRIEF DESCRIPTION OF DRAWINGS

For the purposes of exemplification, the invention will now be further described, with reference to the following Figures in which.

DESCRIPTION OF ILLUSTRATED EMBODIMENT

It will be appreciated that aspects, embodiments and preferred features of the invention have been described herein in a way that allows the specification to be written in a clear and concise way. However, unless circumstances clearly dictate otherwise, aspects, embodiments and preferred features can be variously combined or separated in accordance with the invention. In a preferred embodiment, a device in accordance with the invention comprises all features of the invention.

Within the context of this specification, the word "comprises" means "includes, among other things" and should not be construed to mean "consists of only".

Within the context of this specification, the word "substantially" means preferably at least 90%, more preferably 95%, even more preferably 98%, most preferably 99%.

Within the context of this specification, a barrel of a firearm has a rear end and a front end. The front end of the barrel is the end of the barrel from which a projectile exits when the firearm is fired and the rear end is located at the opposite end of the barrel. In addition, in use, a barrel has a left side and a right side. The left side is the side to the left of a user when they point the front of the barrel away from them. The right side of the barrel is the opposite side to the left side.

Figure 1:
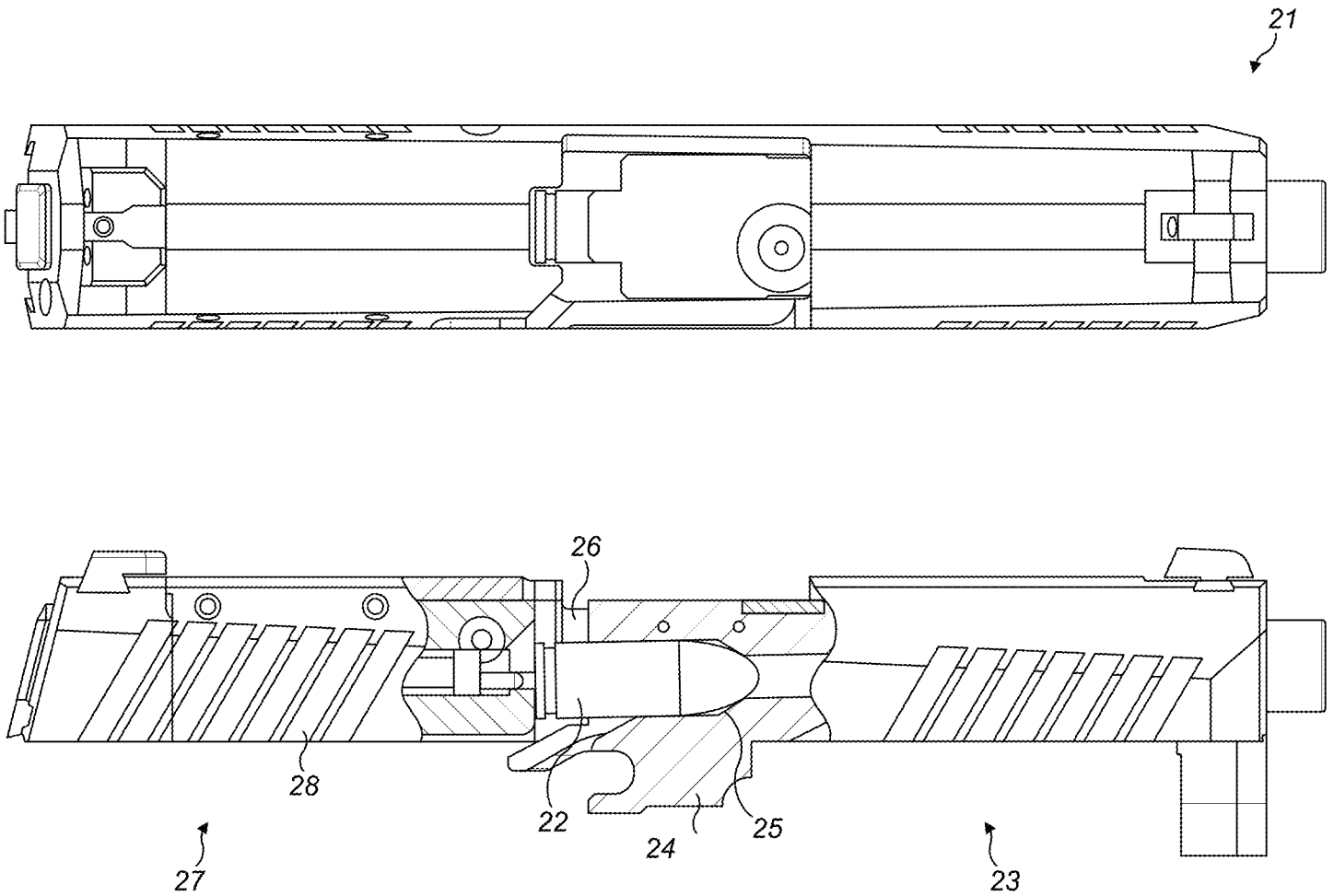
FIG. 1 Prior Art
FIG. 1 shows a live round positioned in the chamber of a known training barrel, the figure shows the slide being held rearwards. The distance a slide has to be held rearwards is not consistent through different weapon types and models so it is possible for the firing pin to be activated and the firing pin can impact upon the round in the chamber and detonate the propellant in the round.

With reference to the Figures, FIG. 1 shows a known conversion kit (21). A live cartridge (22) is positioned in the chamber (25) of a known training barrel (24). The slide (28) of the slide assembly (27) is held rearwards because the cartridge (22) extends from the rear (26) of the barrel (24).

Figure 2:
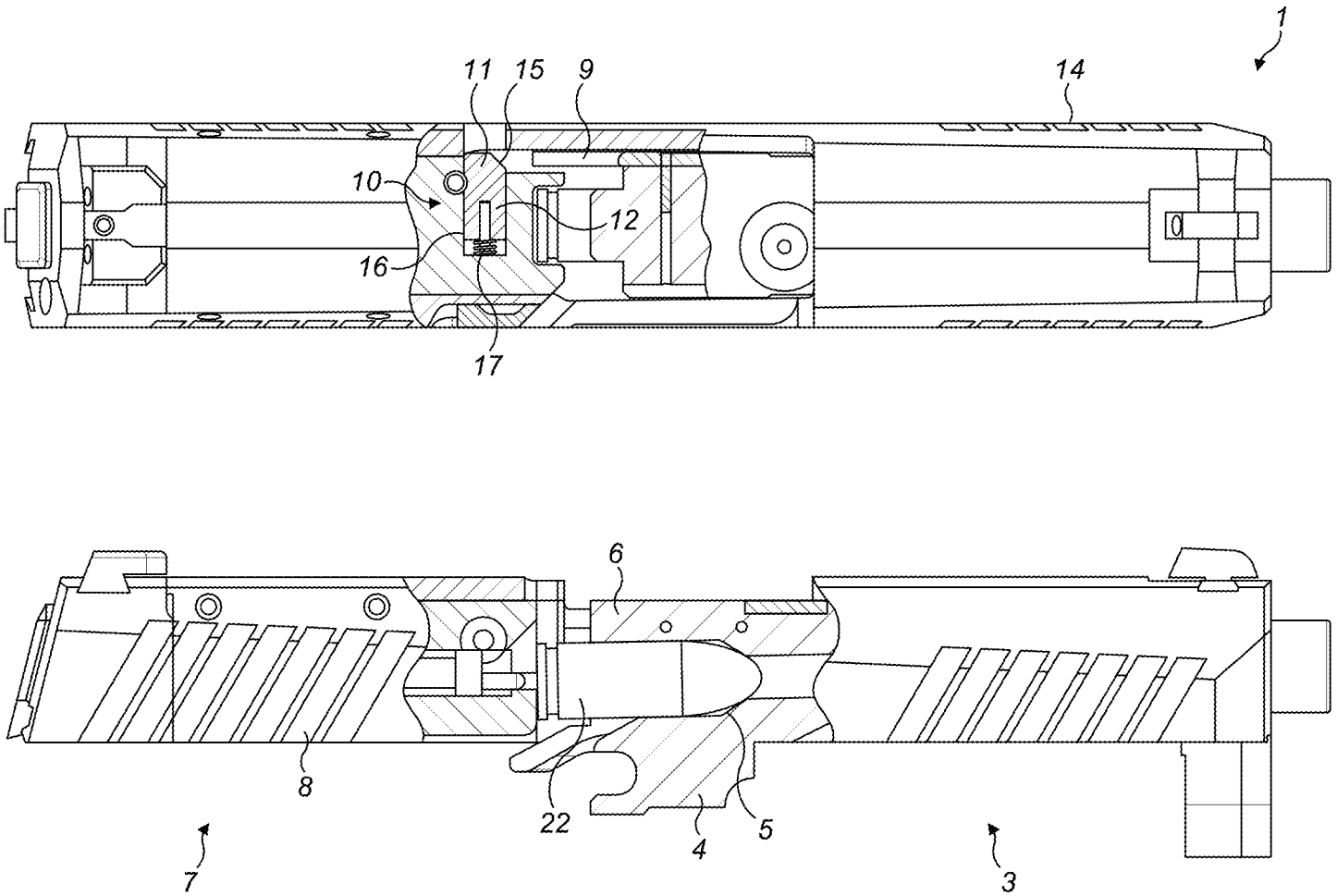
FIG. 2 shows the barrel assembly with a 'safety activation feature' and the slide assembly with a 'Spring loaded stop'. The spring loaded stop has not been activated by the safety activation feature because the live round is holding the slide rewards a sufficient distance, so the sprung loaded stop is in the 'safe' position. The sprung loaded stop will prevent the firing pin from impacting the round and so preventing a live round from discharging.
Figure 3:
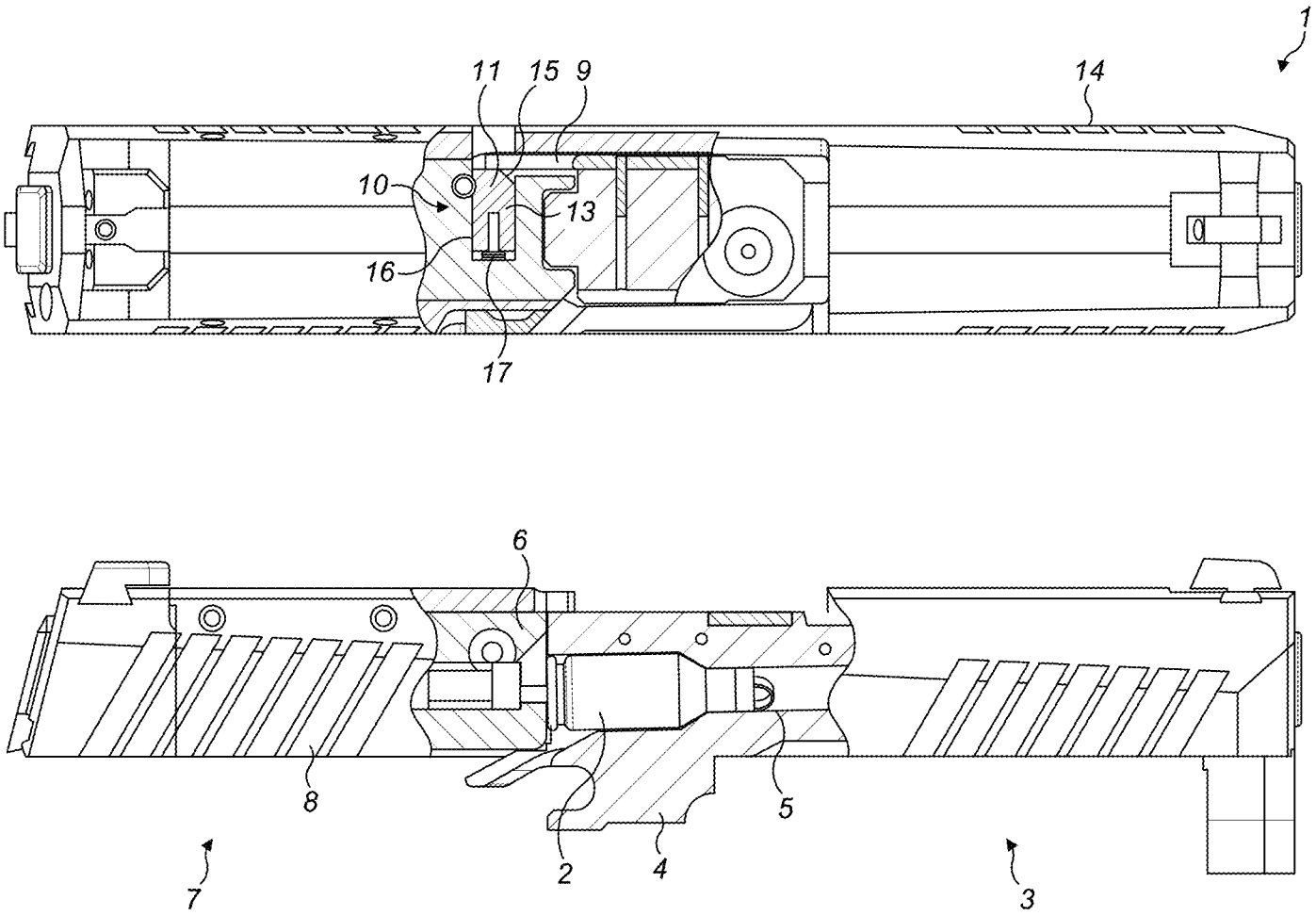
FIG. 3 shows a training round in the barrel assembly with the safety activation feature installed. The slide has the sprung loaded stop installed. The safety activation feature has interacted with the sprung loaded stop and moved it to the fire position allowing the firing pin to impact upon the round and so detonating it.

FIGS. 2 and 3 illustrate an embodiment of a conversion kit (1) of the invention. The conversion kit comprises a barrel assembly (3) and a slide assembly (7). The barrel assembly (3) includes a barrel (4) having a projection (9) and the slide assembly (7) includes a gate (8) having a member (11) which interacts with the projection (9).

The barrel (4) has a chamber (5) which is chambered for receiving training ammunition (2) and it interfaces with the slide assembly (7) which replaces the host weapon slide assembly.

In use, the projection (9) extends from the rear (6) of the barrel (4) and from the left side (14) of the barrel (4).

The gate (10) comprises a member (11) which has a first end (15) that interacts with the projection (9) and a second end (16) that interacts with a spring (17) biasing means. In this regard, the member (11) is spring loaded so that it is biased to a first position (12) by the spring (17).

In use, the member (11) is movable in a plane substantially horizontal and substantially perpendicular to the longitudinal axis of the chamber (5) between the first 'safe' position (12) wherein a firing pin of the firearm is blocked from impacting on a cartridge (22, 2) in the chamber (5) and a second 'fire' position (13) wherein the firing pin is not blocked from impacting upon a cartridge (22, 2) in the chamber (5).

The spring (17) has a longitudinal axis, which is substantially parallel to a longitudinal axis of the member (11). In addition, the longitudinal axes of the spring (17) and the member (11) are substantially perpendicular to the longitudinal axis of the projection (9).

Interaction between the slide assembly (7) and the barrel assembly (3) has been designed so that, in use, the projection (9) acts upon the member (11) of the gate (10) thereby moving it from the first position (12) to the second position (13).

The above described embodiments have been given by way of example only, and the skilled reader will naturally appreciate that many variations could be made thereto without departing from the scope of the invention.

The invention claimed is:

1. A conversion kit for converting a firearm for firing live rounds to fire only non-lethal training ammunition, comprising a barrel assembly, and a slide assembly which replaces a host weapon slide assembly, wherein the barrel assembly includes a barrel which interfaces with the slide assembly, the barrel having a chamber which is configured for receiving training ammunition only, whereas live rounds would project from the rear of the barrel rearwards a distance from the barrel and hold the slide assembly rearwards, and a projection, and wherein the slide assembly includes a gate which interacts with the projection, the gate comprising a member which has a first end and a second end, wherein the first end interacts with the projection in a direct manner and the second end interacts with a biasing means, wherein the member is moveable between a first safe position wherein a firing pin of the firearm is blocked from impacting on a cartridge in the chamber, and the member is movable to a second fire position wherein the firing pin is not blocked from impacting upon a cartridge in the chamber.

2. A conversion kit according to claim 1, wherein the projection extends from a rear of the barrel.

3. A conversion kit according to claim 1, wherein the projection extends from a left side of the barrel.

4. A conversion kit according to claim 2, wherein the gate comprises a member which is substantially cylindrical.

5. A conversion kit according to claim 4, wherein, in use, the member is movable in a plane substantially horizontal and substantially perpendicular to a longitudinal axis of the chamber.

6. A conversion kit according to claim 1, wherein the biasing means comprises a spring.

7. A conversion kit according to claim 6, wherein the spring has a longitudinal axis, which is substantially parallel to a longitudinal axis of the member.

8. A conversion kit according to claim 7, wherein a longitudinal axis of the spring and the member are substantially perpendicular to a longitudinal axis of the projection.

9. A firearm comprising a conversion kit of claim 1.

10. A firearm according to claim 9, wherein the firearm is a pistol.

* * * * *